US007250208B2

(12) United States Patent
Lenz

(10) Patent No.: US 7,250,208 B2
(45) Date of Patent: Jul. 31, 2007

(54) COMPOSITE PRODUCT WITH A THERMALLY STRESSABLE BOND BETWEEN A FIBER REINFORCED MATERIAL AND A FURTHER MATERIAL

(75) Inventor: Eberhard Lenz, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 227 days.

(21) Appl. No.: 10/756,900

(22) Filed: Jan. 14, 2004

(65) Prior Publication Data

US 2004/0191495 A1 Sep. 30, 2004

(30) Foreign Application Priority Data

Jan. 14, 2003 (DE) ..... 103 01 069

(51) Int. Cl.
*D04H 1/00* (2006.01)
*H01J 35/10* (2006.01)

(52) U.S. Cl. ..... 428/292.1; 378/144

(58) Field of Classification Search ..... 228/121, 228/124.1, 122.1; 428/292.1; 378/143, 378/144

See application file for complete search history.

(56) References Cited

U.S. PATENT DOCUMENTS 3,969,754 A * 7/1976 Kuniya et al. ..... 257/768
4,516,255 A * 5/1985 Petter et al. ..... 378/143
6,554,179 B2 * 4/2003 Horner et al. ..... 228/122.1
7,010,093 B2 * 3/2006 Lenz et al. ..... 378/125
2001/0036559 A1 11/2001 Haack et al.
2003/0008105 A1 1/2003 Haack et al.

FOREIGN PATENT DOCUMENTS

| | | |
|---|---|---|
| DE | 38 18 478 | 12/1989 |
| DE | 196 50 061 | 6/1997 |
| WO | WO 00/23272 | 4/2000 |

* cited by examiner

*Primary Examiner*—N. Edwards
(74) *Attorney, Agent, or Firm*—Schiff Hardin LLP

(57) ABSTRACT

In a material bond for a composite product composed of a fiber-reinforced material and a further material, such as an anode for an x-ray tube, wherein the fibers of the fiber-reinforced material exhibit a preferred orientation, and wherein the magnitude of the coefficient of thermal expansion of the fiber-reinforced material is direction dependent and depends on the preferred orientation of the fibers, the preferred orientation of the fibers is aligned, at least in a boundary region between the fiber-reinforced material and the further material, such that the coefficient of thermal expansion of the fiber-reinforced material and the coefficient thermal expansion of the further material are approximately equal along this boundary region, in which the bond is formed.

10 Claims, 2 Drawing Sheets

COMPOSITE PRODUCT WITH A THERMALLY STRESSABLE BOND BETWEEN A FIBER REINFORCED MATERIAL AND A FURTHER MATERIAL

BACKGROUND OF THE INVENTION

1. Field of the Invention

The invention concerns a composite product composed of a fiber-reinforced material and a further material of the type wherein the magnitude of the coefficient of thermal expansion $\alpha_{c/c}$ of the fiber-reinforced material is direction dependent and depends on the preferred orientation of the fibers. The invention moreover concerns an anode for an x-ray tube in which such a composite material with a bond is used.

2. Description of the Prior Art

Material bonds are used in order to be able to combine mechanical or physical properties of individual materials in a common component (composite product). The individual materials can be of different types, such as, for example, natural materials such as wood, building materials such as cement, or materials such as synthetics (plastics). Composite materials also can be used, for example, with concrete reinforced with steel mesh (known as reinforced concrete), with foils reinforced with textiles, or fiber-reinforced materials, for example glass fiber-reinforced plastic or carbon fiber-reinforced graphite. Fiber-reinforced materials also make use of a combination of the various advantages of the materials of which they are composed. For example, the elongation of a tear of the fiber-reinforced material in the direction of the fiber orientation is increased by a high elongation at the break of the fibers. Analogously, for example, a high elasticity can be achieved. Fiber-reinforced materials combine such advantages of the fibers with the advantages of the other material, for example a lower weight. The physical and mechanical properties of fiber-reinforced materials, such as elongation at a break, elongation at a tear, heat conductivity, expansion factor or electrical conductivity, vary dependent on direction, and depend on the fiber orientation.

Material bonds are used, for example, in aerospace, where extraordinarily resistant and elastic structures are required with, at the same time, the lowest possible weight. They also are used in the construction of buildings and bridges where, with the most cost-effective materials possible, static, highly stressable, and moreover long-term stable constructions are required. To combine various electrical properties, material bonds are used in the production of electrical circuit boards composed of isolators and conductors. A further example is the use of material bonds in anodes for x-ray tubes, in order to achieve a combination of advantageous mechanical properties (for example low weight and high stability) and physical properties (for example high heat conductivity and suitable coefficient of thermal expansion).

Depending on the area of application, material bonds are subject to extraordinarily severe thermal stresses. The problem occurs that the materials in the composite product can exhibit different thermal expansion factor that, most notably, lead to large mechanical tensions between the bonded materials given changing temperatures. The tensions can lead to warping of the component, to tears, chipping, flaking or spalling, or to the separation of connected materials. Such thermal problems can already occur in the production process when these involve changing, possibly very high, temperatures. It can occur, for example, that, in thermally aided coating processes, no layer bonding at all can be achieved between the materials, and thus no material bond is produced.

This problem has an effect in a particularly pronounced manner in anodes for x-ray tubes. These are struck by electrons from the cathode of the x-ray tube and generate x-ray radiation from the kinetic energy of the incident electrons. The anode is thereby significantly heated by the electron bombardment. In order to spread the thermal load on the surface of the anode, rotating anodes are typically used in which a circular focal path on the surface of the anode is used in place of a fixed focal spot to generate the x-ray radiation. The anode is rotated by a shaft that normally is composed of a heat-resistant material, for example molybdenum. An anode plate sits on the shaft that, for example, can likewise be composed of molybdenum, or of graphite, and that has a focal path coating suitable for generation of x-ray radiation. This can be formed, for example, of tungsten or from a tungsten-rhenium alloy. Alternatively, the anode plate can be formed of the same material as the focal path coating, as an integrated component. The use of anode plates made of graphite has the advantage that the heat produced on the focal path coating can be well distributed and removed due to the large heat capacity and heat conductivity of graphite, and can be well radiated away due to its heat radiation properties.

In addition to the thermal stress, x-ray tube anodes are also subjected to a significant mechanical stress. The anode (thus focal path, anode and shaft) typically rotates with a rotation speed of just under 3000/min, which makes a strong, precise and stable positioning of the shaft necessary. In order to keep destabilization of the positioning of the shaft low, light anode plates are advantageous. For this reason graphite exhibits advantages in comparison to metals such as molybdenum or tungsten, due to its lower specific weight. The mechanical load of the rotation positioning multiplies given the use of the x-ray tube in computed tomography (CT), in which the x-ray tube is rotated around the patient with rotation speeds of more than 100/min. Depending on the arrangement of the anode or of the shaft, additional mechanical high-stressing centrifugal forces and corolis forces occur.

Given the increased mechanical stresses as a result of the rotation of the anode itself, as well as the entire anode in the CT, and the increased thermal stress given momentary, extreme increases of the x-ray output, most of all in CT applications, the stability of anode plates made of graphite is increasingly critical. Furthermore, the predominant tendency is toward further increases of the CT rotation speeds. The reduction of the individual image times required as a result of this in turn requires an additional increase of the momentary output, and thus an additional increase of the thermal stress. In the future, materials that are even more stressable than is already the case today will be required.

A material that exhibits a high thermal stressability, a low weight and excellent mechanical properties is carbon fiber-reinforced graphite. This material therefore would be an ideal material for a material bond with, depending on the application, further materials to be selected. In particular, graphite would also be an ideal material for a material bond for application in x-ray anodes. However, due to the different coefficient of thermal expansion, production of a stable material bond between carbon fiber-reinforced graphite and the focal path coating (which includes a transition metal such as tungsten) has not been able to be achieved, much less used. The same is true for many other fiber-reinforced materials that should be bound with additional material, and that have proved to be insufficiently stable either in the production or in the subsequent application. The advantages that would arise from a composite of fiber-reinforced materials with further materials thus far have not been realized.

SUMMARY OF THE INVENTION

An object of the invention is to provide a material bond, for a composite product composed of a fiber-reinforced material and a further material, which remains mechanically stable under thermal load. In particular, it is an object of the invention to provide an anode for an x-ray tube in which a material bond that does not lose its mechanical stability given thermal stresses is used between an anode plate composed of carbon fiber-reinforced graphite and a focal path coating made of a refractory metal.

The above object is achieved in accordance with the principles of the present invention in a composite product composed of a fiber-reinforced material and a further material, wherein the fibers of the fiber-reinforced material exhibit a preferred orientation and wherein the magnitude of the coefficient of thermal expansion of the fiber-reinforced material is direction dependent and depends on the preferred orientation of the fibers, wherein a bond between the fiber-reinforced material and the further material is produced by aligning the fibers, at least in a boundary region between the fiber-reinforced material and the further material, and wherein the fibers are aligned at least in the boundary region so that the coefficient of thermal expansion of the fiber-reinforced material and the co-efficient of thermal expansion of the further material are approximately equal in the boundary region in which the bond is formed.

The invention is based on using the influence of the fibers in fiber-reinforced materials on the coefficient of thermal expansion of such materials. The Influence of the fibers (that, in such materials, exhibit a preferred orientation) on the coefficient of thermal expansion is strongest in a direction parallel to the preferred orientation, while in the direction perpendicular to this the influence of the material in which the fibers are embedded is strongest. Depending on the fibers and materials used, a thermal expansion factor of the material bond thus is realized that reaches extreme values in the direction parallel to or in the direction perpendicular to the fiber orientation.

The invention is based on the recognition that the thermal expansion factor in directions that are between the angles parallel or perpendicular to the fiber orientation assume intermediate values between the associated extreme values of the expansion factors. The invention makes use of this by setting the orientation of the fibers of the fiber-reinforced material such that, along the bond to the additional material, a thermal expansion factor arises that corresponds to that of the further material. The advantage is thereby achieved that, given thermal stresses, a stable material bond is achieved between the two materials without unwanted changes of the materials or having to use bonding medium materials, A further advantage is that the materials can be simply bound to one another without additional process steps such as, for example, the application of bonding medium layers.

An embodiment of the invention is based on the further recognition that the heat conductivity of fiber-reinforced materials is also direction-dependent, and depends on the orientation of the fibers. The invention makes use of this by setting the preferred orientation of the fibers such that heat can be selectively dissipated in specific directions, for example away from a component to be cooled. The advantage is achieved that, in addition to the excellent mechanical properties given thermal stresses, the heat-conductivity properties also can be simultaneously influenced and controlled. Additional cooling also can be achieved by selective control of the heat removal.

DESCRIPTION OF THE PREFERRED EMBODIMENTS

Figure 1:
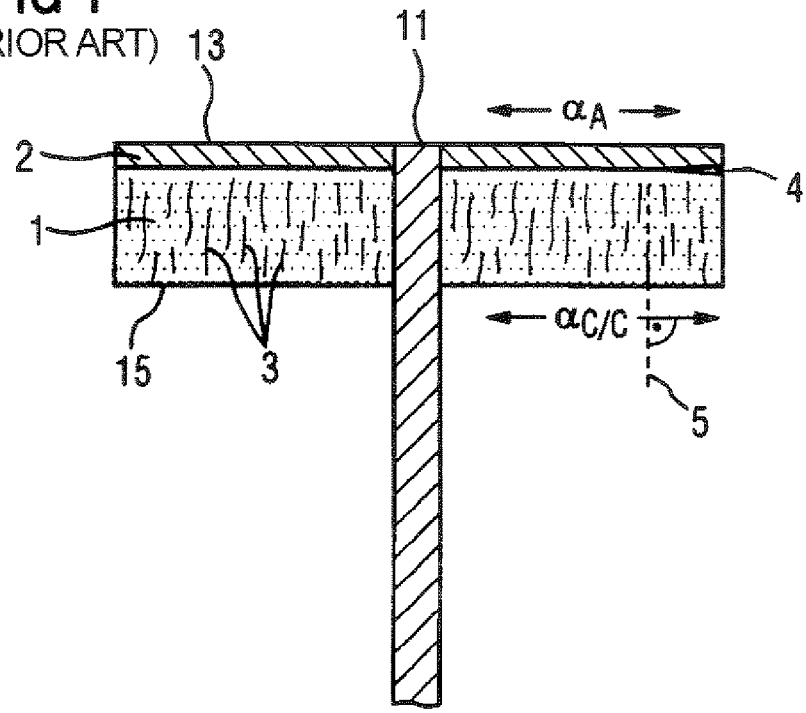
FIG 1 (PRIOR ART)
FIG. 1 illustrates a conventional material bond in the example of an x-ray tube anode.

FIG. 1 shows a composite product with a material bond according to the prior art in the example of an anode for an x-ray tube. The anode is mounted on an anode plate 15 on which a focal path coating is applied. The focal path coating 13 is composed of a refractory metal alloy 2 that is suitable for generation of x-rays and that exhibits a thermal expansion factor $\alpha_A$. The anode plate 15 is composed of a fiber-reinforced material 1 having fibers exhibiting a preferred orientation 5. The thermal expansion factor of the fiber-reinforced material 1 is direction-dependent and depends on the preferred orientation 5 of the fibers 3. The preferred orientation of the fibers 3 is in the lengthwise direction of the anode plate 15, as would, for example, be the case in a section of tube material from the fiber-reinforced material 1. The preferred orientation of the fibers 3 causes the thermal expansion factor of the fiber-reinforced material 1 in the direction of this preferred orientation 5 to differ from the thermal expansion factor $\alpha_{c/c}$ perpendicular thereto.

The anode plate 15 and the focal path coating 13 are attached to a shaft 11. by which they are rotated. The connection between the anode plate 15 and the focal path coating 13 is oriented perpendicular to the shaft 11, and also the coefficient of thermal expansion $\alpha_A$, $\alpha_{c/c}$ are designated in this direction. The different lengths of the arrows represent the different magnitudes of the coefficient of thermal expansion. This has the result that the anode plate 15 expands more significantly than the focal path coating 13 given thermal stress. In conventional material bonds, this expansion difference is so large that, given thermal stress, the focal path coating 13 would flake off, break off, or disengage from the anode plate 15, which in FIG. 1 is indicated by the gap 4 at the right edge of the anode plate 15. Therefore, for such an anode, a production process in which thermal stresses could not be used, much less used in an x-ray tube.

Figure 2:
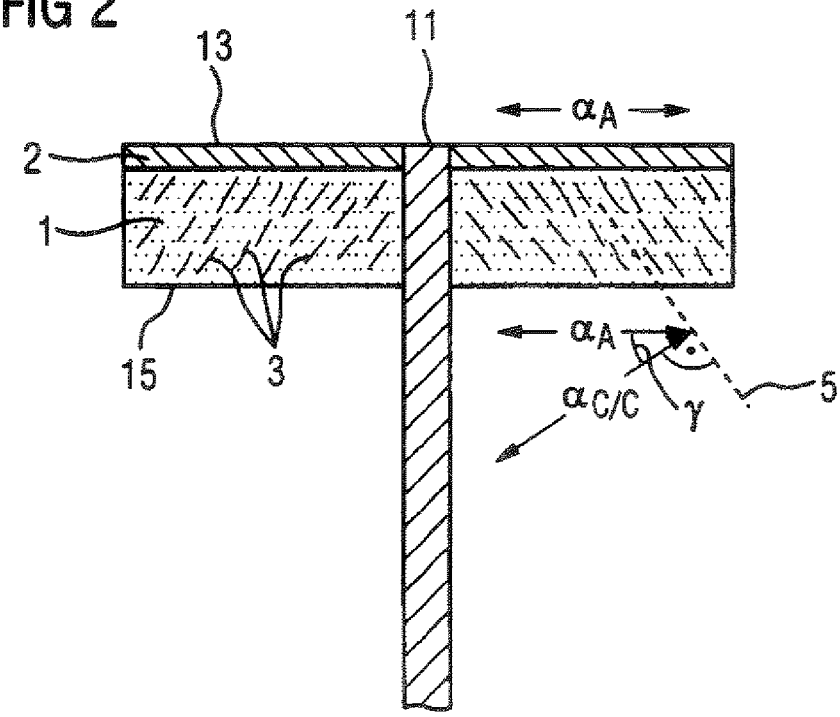
FIG. 2 illustrates a material bond according to the invention the example of an x-ray tube anode.

FIG. 2 shows an anode according to the invention. The anode basically has the same assembly as the anode described in FIG. 1, with a shaft 11, an anode plate 15 and a focal path coating 13. The fibers 3 of the fiber-reinforced material 1, however, are oriented differently. For the representation in FIG. 2, it has been assumed that the thermal expansion factor of the material 1 in the direction of the preferred orientation 5 of the fibers 3 is almost vanishingly small. This does not necessarily have to be the case, however it applies for carbon-reinforced graphite. Under this assumption, a change of the preferred orientation 5 means that the thermal expansion factor of the anode plate 14 along the connection to the focal path coating 13 is smaller, According to the invention, the preferred orientation 5 of the fibers 3 is rotated such that the thermal expansion factor of the anode plate 15 in the direction in question substantially equals that of the focal path coating 13.

This is indicated in FIG. 2, by the preferred orientation 5 being rotated by the angle $\gamma$. The angle $\gamma$ is selected such that the projection of the coefficient of thermal expansion $\alpha_{c/c}$ of the anode plate 15 and the focal path coating 13 directly correspond to the thermal expansion factor $\alpha_A$ of the focal path coating. Mathematically, this relationship can be expressed as:

$$\cos\gamma=\alpha_a/\alpha_{c/c}.$$

This mathematical equation need not correctly reproduce the appropriate rotation angle $\gamma$ for all fiber-reinforced materials 1, however it conveys the fundamental ideas of the invention as an example.

The illustrated anode should exhibit a lowest possible weight, with a high thermal stressability, in order that it be suitable for CT applications. A light, fiber-reinforced material 1 with excellent mechanical properties for use as an anode plate 15 is carbon-reinforced graphite. As material 2 for the focal path coating 13, materials must be used that are suitable for generation of x-rays, for example tungsten or tungsten-rhenium alloys. A thermally stressable connection between these two materials can only be produced by adaptation of the coefficient of thermal expansion in the described manner.

In the production of the bond between the focal path coating 13 and the anode plate 15, coating processes are used to apply the coating, for example vacuum-plasma spraying, or soldering processes are used to bind the bond partners. In these processes, the connection between both materials is also generated by thermal activation. If the coefficient of thermal expansion are not adapted, the production of the bond proves to be impossible. The invention succeeds in adapting the coefficient of thermal expansion such that not only the coating process or bonding process, but also the later use of the bond as a thermally stressable x-ray anode, are possible.

The fibers 3 need not necessarily be oriented in the direction 5 shown in FIG. 2. Instead of a counter-clockwise rotation by the angle $\gamma$, they can be rotated clockwise by the same angle $\gamma$. Which of the two possible orientations is selected influences the thermal properties of the fiber-reinforced material 1. Just like the thermal expansion factor, namely the thermal conductivity is normally also dependent on the preferred orientation 5 of the fibers 3. It is normally particularly large in the direction of the preferred orientation 5, which means that heat can be transported particularly well in this direction. In FIG. 2, the preferred orientation 5 is shown such that heat that is generated on the focal path 13 is dissipated away by the anode plate 15 to its outside, A large amount of heat is radiated outwardly from the edges of the anode plate 15, not in the least because of the good radiation properties of graphite. The large radiated heat flow makes additional cooling measures superfluous. At the same time, the bearing system of the shaft 11 is protected from too large a heat charge by the radiation of the heat via the plate edge.

Figure 3:
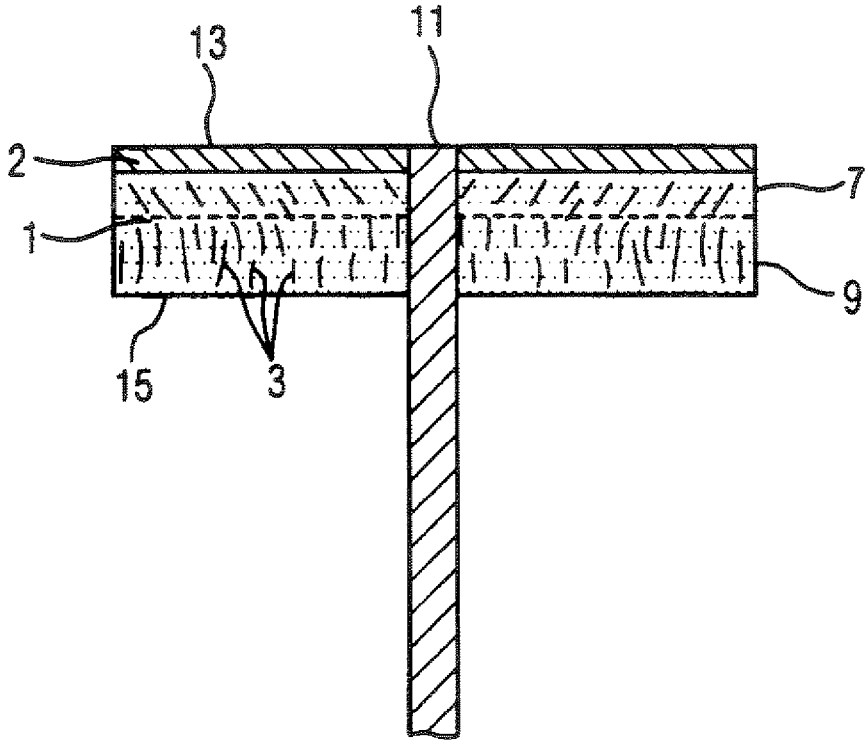
FIG. 3 illustrates a material bond according to a variant of the invention in the example of an x-ray tube anode.

FIG. 3 shows a variant of the material bond according to the invention in the example of an anode plate as basically already has been described in FIG. 2. The fiber-reinforced material 1, however, is modified such that the alignment of the fibers 3 is not oriented the same throughout the entire anode plate, Instead, they are aligned in a region 7 near the focal path 13 such that—as already illustrated in FIG. 2—a suitable thermal expansion factor is realized along the bond between anode plate 15 and focal path 13. However, in another region 9 that is not near to the bond to the focal path 13, the fibers 3 are oriented differently. A different thermal expansion factor is thus realized in the region 9 than in the region 7, that if necessary can be optimized under other considerations, for example in adaptation to the shaft 11. Moreover, by the alignment of the fibers 3 in the region 9, the heat can be conducted in another direction than in the region 7. If necessary, an independent orientation of the coefficient of thermal expansion in the region 7 and the heat conductivity direction in the region 9 can be undertaken, Although modifications and changes may be suggested by those skilled in the art, it is the intention of the inventor to embody within the patent warranted hereon all changes and modifications as reasonably and properly come within the scope of his contribution to the art.

I claim as my invention:

1. A composite product comprising:

a fiber-reinforced material containing fibers exhibiting a preferred orientation, and having a coefficient of thermal expansion that is direction dependent and that depends on said preferred orientation of the fibers;

a further material, having a coefficient of thermal expansion, disposed relative to said fiber-reinforced material with a boundary plane therebetween and a boundary region at said boundary plane; and a bond in said boundary region bonding said fiber-reinforced material and said further material, said fibers in said boundary region being aligned at a non-zero angle relative to said boundary plane to make said coefficient of thermal expansion of said fiber-reinforced material and said coefficient of thermal expansion of said further material substantially equal in a direction parallel to said boundary plane in said boundary region.

2. A composite product as claimed in claim 1 wherein said fiber-reinforced material has a heat conductivity with a magnitude that is direction dependent and that depends on said preferred orientation of said fibers, and wherein said fibers of said fiber-reinforced material outside of said boundary region are aligned in a direction to maximize said magnitude of said heat conductivity.

3. An anode for an x-ray tube, said anode comprising:

an anode plate composed of a fiber-reinforced material containing fibers exhibiting a preferred orientation, and having a coefficient of thermal expansion that is direction dependent and that depends on said preferred orientation of the fibers;

a focal path composed of a further material, having a coefficient of thermal expansion, disposed relative to said fiber-reinforced material with a boundary plane therebetween and a boundary region at said boundary plane; and a bond in said boundary region bonding said fiber-reinforced material and said further material, said fibers in said boundary region being aligned at a non-zero angle relative to said boundary plane to make said coefficient of thermal expansion of said fiber-reinforced material and said coefficient of thermal expansion of said further material substantially equal in a direction parallel to said boundary plane in said boundary region.

4. An anode as claimed in claim 3 wherein said fiber-reinforced material has a heat conductivity with a magnitude that is direction dependent and that depends on said preferred orientation of said fibers, and wherein said fibers of said fiber-reinforced material outside of said boundary region are aligned in a direction to maximize said magnitude of said heat conductivity.

5. An anode as claimed in claim 3 wherein said fiber-reinforced material of said anode plate comprises carbon fiber-reinforced graphite.

6. An anode as claimed in claim 5 wherein said further material of said focal path is comprised of a refractory metal and is applied to said carbon fiber-reinforced graphite by a process involving application of heat.

7. An anode as claimed in claim 6 wherein said refractory material is selected from the group consisting of tungsten and tungsten-rhenium alloys.

8. An anode as claimed in claim 6 wherein said process is a coating process.

9. An anode as claimed in claim 8 wherein said coating process is vacuum-plasma spraying.

10. An anode as claimed in claim 6 wherein said process is a soldering process.

* * * * *